US010197324B2

(12) United States Patent
Lee et al.

(10) Patent No.: US 10,197,324 B2
(45) Date of Patent: Feb. 5, 2019

(54) REFRIGERATOR AND METHOD FOR CONTROLLING THE SAME

(71) Applicant: LG Electronics Inc., Seoul (KR)

(72) Inventors: Sangbong Lee, Seoul (KR); Jangseok Lee, Seoul (KR); Hyoungkeun Lim, Seoul (KR); Myungjin Chung, Seoul (KR); Minkyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 422 days.

(21) Appl. No.: 14/532,698

(22) Filed: Nov. 4, 2014

(65) Prior Publication Data

US 2015/0121920 A1 May 7, 2015

(30) Foreign Application Priority Data

Nov. 4, 2013 (KR) ..... 10-2013-0133028
Jun. 19, 2014 (KR) ..... 10-2014-0075097

(51) Int. Cl.
*F25D 11/02* (2006.01)
*F25B 40/02* (2006.01)
(Continued)

(52) U.S. Cl.
CPC ..... *F25D 11/022* (2013.01); *F25B 1/005* (2013.01); *F25B 1/10* (2013.01); *F25B 5/02* (2013.01);
(Continued)

(58) Field of Classification Search
CPC ..... F25D 11/022; F25B 40/02; F25B 5/02
(Continued)

(56) References Cited

U.S. PATENT DOCUMENTS 2,402,802 A * 6/1946 Carter ..... F25B 39/028 62/504
5,390,507 A * 2/1995 Shimoya ..... B60H 1/3227 62/200
(Continued)

FOREIGN PATENT DOCUMENTS

CN 1375673 10/2002
CN 1886626 12/2006
(Continued)

OTHER PUBLICATIONS

Machine Translation of FR 2,731,780; Lego, Sep. 20, 1996, EspaceNet, FR 2,731,780, all.*
(Continued)

*Primary Examiner* — Filip Zec
(74) *Attorney, Agent, or Firm* — KED & Associates, LLP

(57) ABSTRACT

A refrigerator and a method for controlling the same may be provided. The refrigerator includes a compressor, a condenser condensing the refrigerant compressed in the compressor, a refrigerant tube for guiding the refrigerant condensed in the condenser, a flow adjustment part coupled to the refrigerant tube to divide the refrigerant into a plurality of refrigerant passages, a plurality of expansion devices respectively disposed in the plurality of refrigerant passages to decompress the refrigerant condensed in the condenser, a plurality of evaporators evaporating the refrigerant decompressed in the plurality of expansion devices, and a supercooling heat exchanger disposed at an outlet-side of the condenser to supercool the refrigerant. The refrigerant supercooled in the supercooling heat exchanger may be introduced into the flow adjustment part.

15 Claims, 9 Drawing Sheets

(51) Int. Cl.

| | |
|---|---|
| ***F25B 1/00*** | (2006.01) |
| ***F25B 49/02*** | (2006.01) |
| ***F25B 1/10*** | (2006.01) |
| ***F25B 5/02*** | (2006.01) |

(52) U.S. Cl.
CPC ..... *F25B 40/02* (2013.01); *F25B 49/02* (2013.01); *F25B 2600/01* (2013.01)

(58) Field of Classification Search
USPC ..... 62/513, 519, 525
See application file for complete search history.

(56) References Cited

U.S. PATENT DOCUMENTS

| | | | | |
|---|---|---|---|---|
| 5,632,161 | A * | 5/1997 | Shimoya | F25B 39/022 62/113 |
| 5,678,419 | A * | 10/1997 | Sanada | B60H 1/3227 62/196.4 |
| 6,370,895 | B1 * | 4/2002 | Sakuma | F25B 5/02 62/152 |
| 7,475,557 | B2 * | 1/2009 | Yoshioka | F25B 1/10 62/175 |
| 2006/0168997 | A1 * | 8/2006 | Imai | F25B 5/02 62/513 |
| 2008/0190125 | A1 | 8/2008 | Yoshioka et al. | |
| 2010/0089094 | A1 * | 4/2010 | Kondou | F25B 5/02 62/498 |

FOREIGN PATENT DOCUMENTS

| | | | | |
|---|---|---|---|---|
| DE | 19647011 | A1 | 5/1997 | |
| EP | 1 243 880 | | 9/2002 | |
| EP | 1 541 944 | | 6/2005 | |
| EP | 1 541 944 | A1 | 6/2005 | |
| EP | 2 278 239 | A2 | 1/2011 | |
| EP | 2 413 068 | | 2/2012 | |
| FR | 2731780 | A1 * | 9/1996 | F25B 40/02 |
| JP | 11-311476 | A | 11/1999 | |
| JP | 2001-263902 | | 9/2001 | |
| JP | 2006-242506 | | 9/2006 | |

OTHER PUBLICATIONS

European Search Report issued in Application No. 14191509.0 dated Apr. 2, 2015.
Chinese Office Action for Application 2016053101953150 dated Jun. 3, 2016 (full Chinese text).

* cited by examiner

REFRIGERATOR AND METHOD FOR CONTROLLING THE SAME

CROSS-REFERENCE TO RELATED APPLICATIONS

The present application claims priority under 35 U.S.C. 119 and 35 U.S.C. 365 from Korean Patent Application No. 10-2013-0133028, filed on Nov. 4, 2013, and No. 10-2014-0075097, filed on Jun. 19, 2014, the subject matters of which are hereby incorporated by reference.

BACKGROUND

1. Field

Embodiments may relate to a refrigerator and a method for controlling the same.

2. Background

A refrigerator has a plurality of storage compartments for accommodating foods to be stored so as to store the foods in a frozen or refrigerated state. The storage compartment may have one surface that is opened to receive or dispense the foods. The plurality of storage compartments include a freezing compartment for storing foods in the frozen state and a refrigerating compartment for storing foods in the refrigerated state.

A refrigeration system in which a refrigerant is circulated is driven in the refrigerator. The refrigeration system may include a compressor, a condenser, an expansion device, and an evaporator. The evaporator may include a first evaporator disposed at a side of the refrigerating compartment and a second evaporator disposed at a side of the freezing compartment.

Cool air stored in the refrigerating compartment may be cooled while passing through the first evaporator, and the cooled cool air may be supplied again into the refrigerating compartment. The cool air stored in the freezing compartment may be cooled while passing through the second evaporator, and the cooled air may be supplied again into the freezing compartment.

As described above, in the refrigerator according to disadvantageous arrangements, independent cooling may be performed in the plurality of storage compartments through separate evaporators. The plurality of storage compartments are not simultaneously cooled, and one storage compartment and the other storage compartment are selectively or alternately cooled.

In this example, although the storage compartment in which the cooling is performed is maintained to an adequate temperature, the storage compartment in which the cooling is not performed may increase in temperature and thus get out of a normal temperature range. In a state where the cooling of one storage compartment is required, if it is determined that the other storage compartment gets out of the normal temperature range, then the other storage compartment may not be immediately cooled.

As a result, in the structure in which the storage compartments are independently cooled, the cool air is not supplied at a suitable time and this may cause lacking of the refrigerant during the operation, thereby deteriorating operation efficiency of the refrigerator.

BRIEF DESCRIPTION OF THE DRAWINGS

The embodiments will be described in detail with reference to the following drawings in which like reference numerals refer to like elements and wherein.

DETAILED DESCRIPTION OF THE EMBODIMENTS

Exemplary embodiments may be described with reference to the accompanying drawings. Embodiments may, however, be embodied in many different forms and should not be construed as being limited to the embodiments set forth herein.

Figure 1:
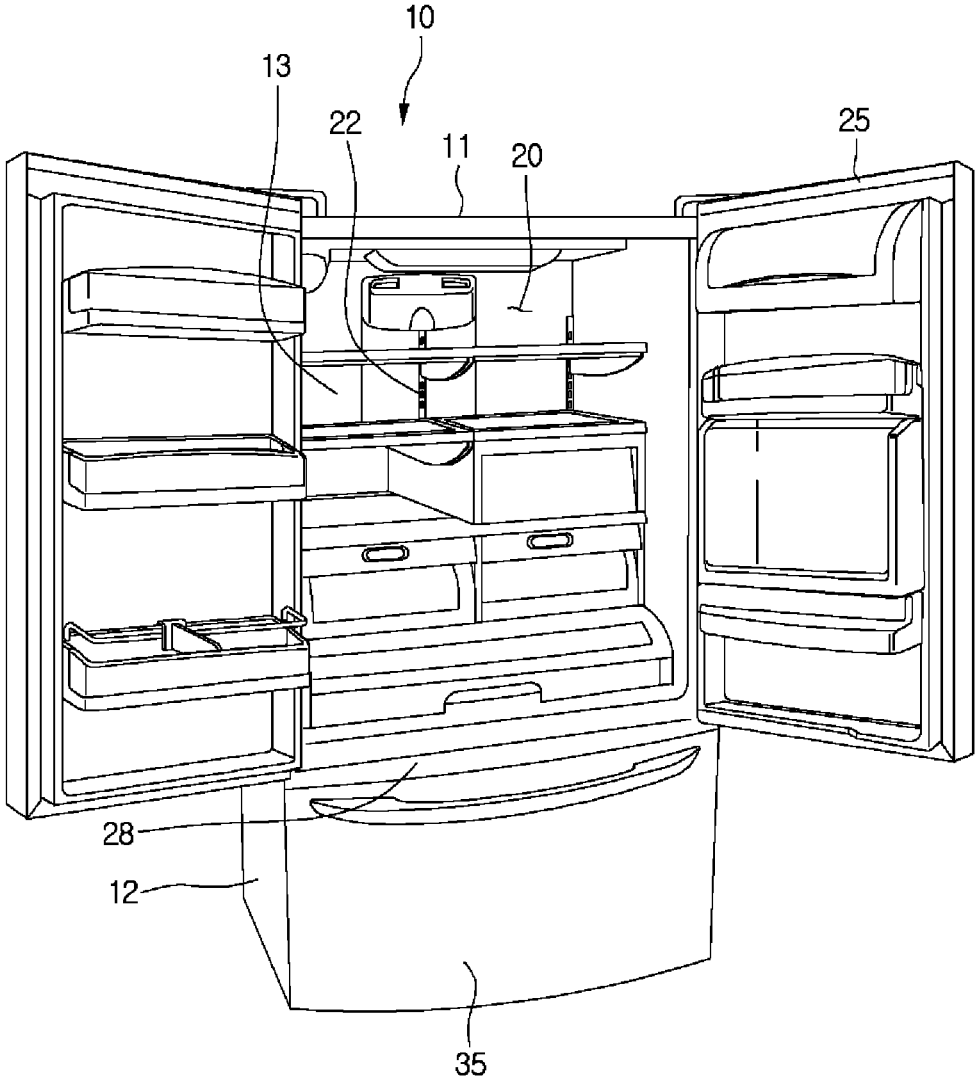
FIG. 1 is a perspective view of a refrigerator according to a first embodiment.
Figure 2:
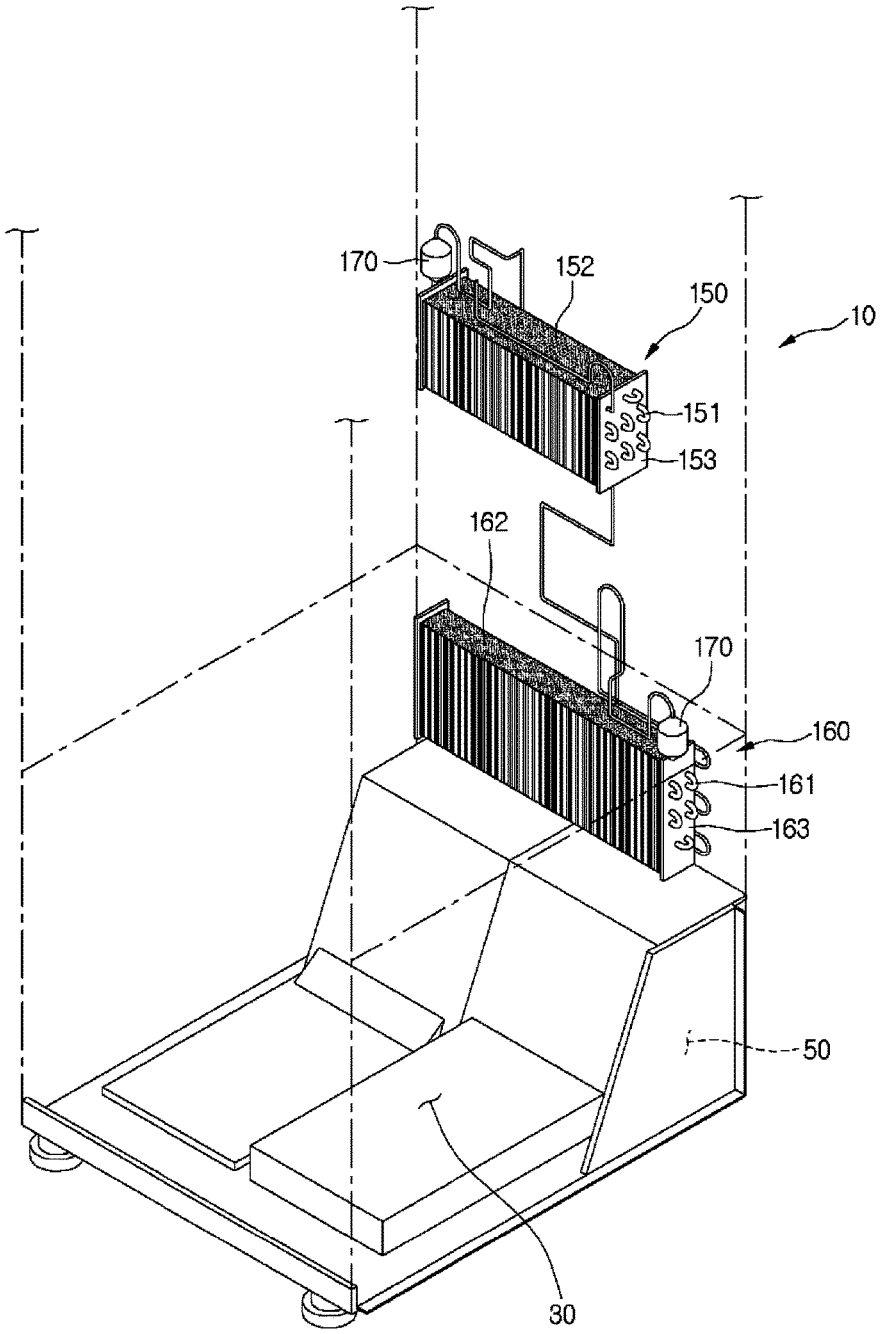
FIG. 2 is a view illustrating a portion of constitutions of the refrigerator according to the first embodiment.
Figure 3:
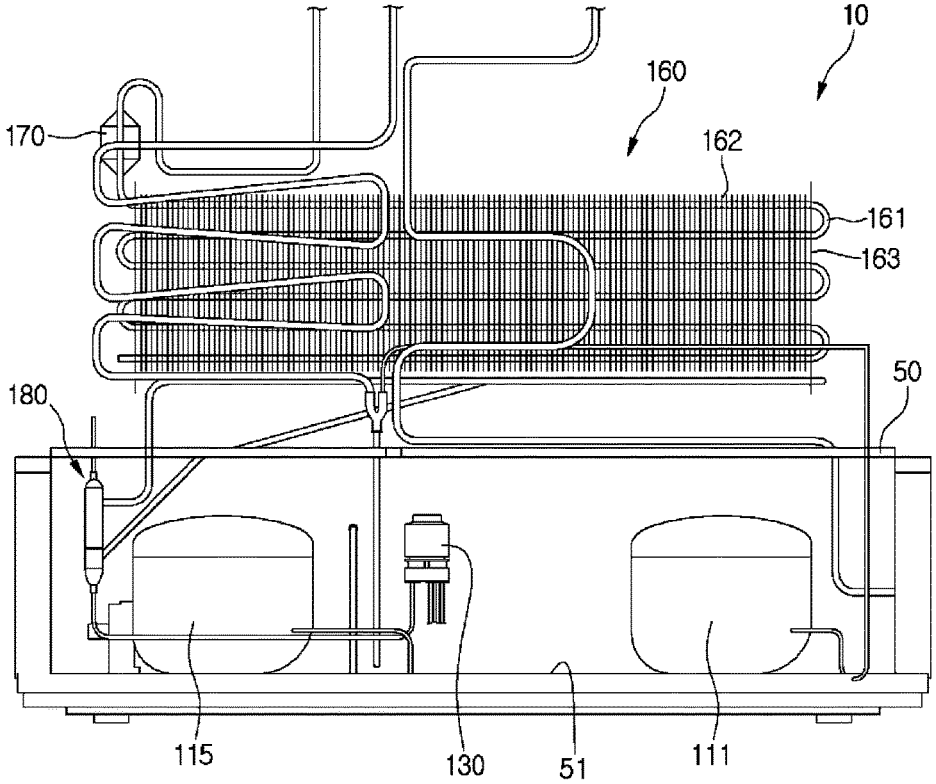
FIG. 3 is a rear view of the refrigerator according to the first embodiment.

FIG. 1 is a perspective view of a refrigerator according to a first embodiment. FIG. 2 is a view illustrating a portion of constitutions of the refrigerator according to the first embodiment. FIG. 3 is a rear view of the refrigerator according to the first embodiment. Other embodiments and configurations may also be provided.

Referring to FIGS. 1 to 3, a refrigerator 10 may include a main body 11 defining a storage compartment. The storage compartment includes a refrigerating compartment 20 and a freezing compartment 30. For example, the refrigerating compartment 20 may be disposed above the freezing compartment 30. However, the embodiments are not limited to the positions of the refrigerating compartment 20 and the freezing compartment 30.

The refrigerating compartment and the freezing compartment may be partitioned by a partition wall 28.

The refrigerator 10 may include a refrigerating compartment door for opening or closing the refrigerating compartment 20 and a freezing compartment door 35 for opening or closing the freezing compartment 30. The refrigerating compartment door 25 may be hinge-coupled to the main body 10 to rotate, and the freezing compartment door 35 may be provided in a drawer type and thus be withdrawable forward.

The main body 11 may include an outer case 12 defining an exterior of the refrigerator 10 and an inner case 13 disposed inside the outer case 12 to define at least one portion of an inner surface of the refrigerating compartment 20 or freezing compartment 30. An insulation material may be disposed between the outer case 12 and the inner case 13.

A refrigerating compartment cool air discharge part 22 for discharging cool air into the refrigerating compartment 20 may be disposed in a rear wall of the refrigerating compartment 20. A freezing compartment cool air discharge part for discharging cool air into the freezing compartment 30 may be disposed in a rear wall of the freezing compartment 30.

The refrigerator 10 may include a plurality of evaporators for independently cooling the refrigerating compartment 20 and the freezing compartment 30. The plurality of evaporators may include a first evaporator 150 for cooling one storage compartment of the refrigerating compartment 20 and the freezing compartment 30 and a second evaporator 160 for cooling the other storage compartment.

For example, the first evaporator 150 may function as a refrigerating compartment evaporator for cooling the refrigerating compartment 20, and the second evaporator 160 may function as a freezing compartment evaporator for cooling the freezing compartment 30. Since the refrigerating compartment 20 is disposed above the freezing compartment 30, the first evaporator 150 may be disposed above the second evaporator 160.

The first evaporator 150 may be disposed at a rear side of the rear wall of the refrigerating compartment 20, and the second evaporator 160 may be disposed at a rear side of the rear wall of the freezing compartment 30. The cool air generated in the first evaporator 150 may be supplied into the refrigerating compartment 20 through the refrigerating compartment cool air discharge part 22, and the cool air generated in the second evaporator 160 may be supplied into the freezing compartment 30 through the freezing compartment cool air discharge part.

The first evaporator 150 may include a first refrigerant tube 151 in which the refrigerant flows, a fin 152 coupled to the first refrigerant tube 151 to increase a heat-exchange area between the refrigerant and a fluid, and a first fixing bracket 153 for fixing (or attaching) the first refrigerant tube 151. The first fixing bracket 153 may be provided in plurality on both sides of the first refrigerant tube 151.

The second evaporator 160 may include a second refrigerant tube 161 in which the refrigerant flows, a second fin 162 coupled to the second refrigerant tube 161 to increase a heat-exchange area between the refrigerant and the fluid, and a second fixing bracket 163 for fixing (or attaching) the second refrigerant tube 161. The second fixing bracket 163 may be provided in plurality on both sides of the second refrigerant tube 161.

The first and second refrigerant tubes 151 and 161 may be bent in one direction and the other direction, respectively. The first and second fixing brackets 153 and 163 may be fixed (or attached) to both sides of the first and second refrigerant tubes 151 and 161 to prevent the first and second refrigerant tubes from being shaken, respectively. For example, the first and second refrigerant tubes 151 and 161 may be disposed to pass through the first and second fixing brackets 153 and 163, respectively.

A gas/liquid separator 170 for filtering a liquid refrigerant of the refrigerant evaporated in the first and second evaporators 150 and 160 to supply a gaseous refrigerant into first and second compressors 111 and 115 may be disposed at a side of each of the first and second evaporators 150 and 160.

A machine room 50 in which main components of the refrigerator are disposed may be defined in a rear lower portion of the refrigerator 10 (i.e., a rear side of the freezing compartment 30). For example, the compressor and the condenser are disposed in the machine room 50.

Referring to FIG. 3, the plurality of compressors 111 and 115 for compressing the refrigerant and the condenser (reference numeral 120 of FIG. 4) for condensing the refrigerant compressed in the plurality of compressors 111 and 115 are disposed in the machine room 50. The plurality of compressors 111 and 115 and the condenser 120 may be placed on a base 51 of the machine room 50. The base 51 may define a bottom surface of the machine room 50.

A valve device 130 (or valve) that serves as a flow adjustment part for adjusting a flow direction of the refrigerant to supply the refrigerant into the first and second evaporators 150 and 160 may be disposed in the machine room 50. The valve device 130 may also be called a flow adjustment part.

An amount of refrigerant introduced into the first and second evaporators 150 and 160 may vary based on control of the valve device 130. In other words, refrigerant concentration into one evaporator of the first and second evaporators 150 and 160 may occur according to a control state of the valve device 130. The valve device 130 may include a four-way valve.

A dryer 180 for removing moisture or impurities contained in the refrigerant condensed in the condenser 120 may be disposed in the machine room 50. The dryer 180 may temporally store the liquid refrigerant introduced therein. Since the dryer 180 is disposed between the condenser 120 and the valve device 130, the refrigerant passing through the dryer 180 may be introduced into the valve device 130.

Figure 4:
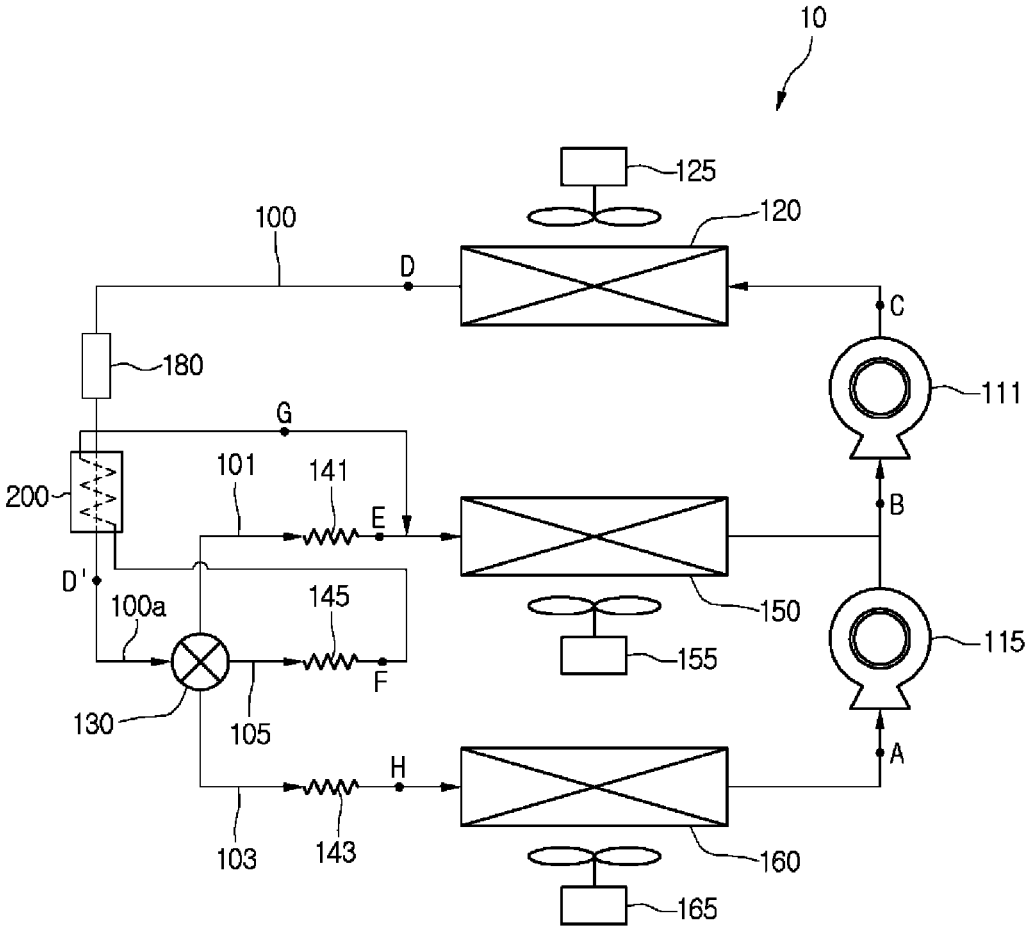
FIG. 4 is a view illustrating a system having a refrigeration cycle in the refrigerator according to the first embodiment.

FIG. 4 is a view illustrating a system having a refrigeration cycle in the refrigerator according to the first embodiment. Other embodiments and configurations may also be provided.

Referring to FIG. 4, the refrigerator 10 may include a plurality of devices for driving a refrigeration cycle.

The refrigerator 10 includes the plurality of compressors 111 and 115 for compressing a refrigerant, the condenser 120 for condensing the refrigerant compressed in the plurality of compressors 111 and 115, a plurality of expansion devices 141, 143, and 145 for decompressing the refrigerant condensed in the condenser 120, and the plurality of evaporators 150 and 160 for evaporating the refrigerant decompressed in the plurality of expansion devices 141, 143, and 145.

The refrigerator 10 may include a refrigerant tube 100 connecting the plurality of compressors 111 and 115, the condenser 120, the expansion devices 141, 143, and 145, and the evaporators 150 and 160 to each other to guide flow of the refrigerant.

The plurality of compressors 111 and 115 may include a second compressor 115 disposed at a low-pressure side and a first compressor 111 for further compressing the refrigerant compressed in the second compressor 115.

The first compressor 111 and the second compressor 115 are connected to each other in series. That is, an outlet-side refrigerant tube of the second compressor 115 is connected to an inlet-side of the first compressor 111.

The plurality of evaporators may include a first evaporator 150 for generating cool air to be supplied into one storage compartment of the refrigerating compartment and the freezing compartment and a second evaporator 160 for generating cool air to be supplied into the other storage compartment.

For example, the first evaporator 150 may generate cold air to be supplied into the refrigerating compartment and be disposed on one side of the refrigerating compartment. The second evaporator 160 may generate cold air to be supplied into the freezing compartment and be disposed on one side of the freezing compartment. Thus, the first evaporator 150 may be called a refrigerating compartment-side evaporator, and the second evaporator 160 may be called a freezing compartment-side evaporator.

The cool air to be supplied into the freezing compartment may have a temperature less than that of the cool air to be supplied into the refrigerating compartment. Thus, a refrigerant evaporation pressure of the second evaporator 160 may be less than that of the first evaporator 150.

An outlet-side refrigerant tube 100 of the second evaporator 160 may extend to an inlet-side of the second compressor 115. Thus, the refrigerant passing through the second evaporator 160 may be introduced into (or to) the second compressor 115.

The outlet-side refrigerant tube 100 of the first evaporator 150 may be connected to the outlet-side refrigerant tube of the second compressor 115. Thus, the refrigerant passing through the first evaporator 150 may be mixed with the refrigerant compressed in the second compressor 115, and then the mixture may be suctioned into (or to) the first compressor 111.

The plurality of expansion devices may include first and third expansion devices 141 and 145 for expanding refrigerant to be introduced into the first evaporator 150 and a second expansion device 143 for expanding the refrigerant to be introduced into the second evaporator 160. Each of the first to third expansion devices 141, 143, and 145 may include a capillary tube.

A plurality of refrigerant passages for guiding the introduction of the refrigerant into (or to) the first evaporator 150 may be defined in the inlet-side of the first evaporator 150.

The plurality of refrigerant passages may include a first refrigerant passage 101 in which the first expansion device 141 is disposed and a third refrigerant passage 105 in which the third expansion device 145 is disposed. The first and third refrigerant passages 101 and 105 may be called a first evaporation passage in that the first and third refrigerant passages 101 and 105 guide the introduction of the refrigerant into the first evaporator 150.

The refrigerant flowing into (or to) the first refrigerant passage 101 may be decompressed in the first expansion device 141, and the refrigerant flowing to the third refrigerant passage 105 may be decompressed in the third expansion device 145 and then be heat-exchanged in a supercooling heat exchanger 200. The refrigerant heat-exchanged in the supercooling heat exchanger 200 may be mixed with the refrigerant decompressed in the first expansion device 141 and then be introduced into (or to) the first evaporator 150.

The third refrigerant passage 105 may be a supercooling passage for guiding the refrigerant into (or to) the supercooling heat exchanger 200.

A second refrigerant passage 103 for guiding the introduction of the refrigerant into (or to) the second evaporator 160 is defined in an inlet-side of the second evaporator 160. The second expansion device 143 may be disposed in the second refrigerant passage 103. The second refrigerant passage 103 may be called a second evaporation passage in that the second refrigerant passage 103 guides the introduction of the refrigerant into (or to) the second evaporator 160.

The first to third refrigerant passages 101, 103, and 105 may be branch passages that branch from the refrigerant tube 100.

The refrigerator 10 may further include the valve device 130 for dividing and introducing the refrigerant into at least two refrigerant passages of the first to third refrigerant passages 101, 103, and 105. The valve device 130 may be a device for simultaneously operating the first and second evaporators 150 and 160 (i.e., for adjusting a flow of the refrigerant so that the refrigerant is introduced into the first and second evaporators 150 and 160) at a same time.

The valve device 130 may include a four-way valve having one inflow part through which the refrigerant is introduced and three discharge parts through which the refrigerant is discharged.

The three discharge parts of the valve device 130 are connected to the first to third refrigerant passages 101, 103, and 105, respectively. Thus, the refrigerant passing through the valve device 130 may be divided (or separated) into at least two refrigerant passages of the first to third refrigerant passages 101, 103, and 105 and be expanded in at least two expansion devices of the first to third expansion devices 141, 143, and 145.

The valve device 130 may be controlled to cause the refrigerant concentration into one evaporator according to an operation mode of the refrigerator. The operation mode of the refrigerator may include a simultaneous operation mode in which cooling operations of the refrigerating compartment and the freezing compartment are performed, a refrigerating compartment operation mode in which the cooling operation of the refrigerating compartment is performed, and a freezing compartment operation mode in which the cooling operation of the freezing compartment is performed.

For example, when the simultaneous operation mode is performed, the refrigerant may be supplied into (or to) the first and second evaporators 150 and 160. The valve device 130 may be controlled so that the refrigerant is divided and supplied into (or to) the first to third refrigerant passages 101, 103, and 105. That is, the valve device 130 may operate to open all of the three discharge parts.

When all of the three discharge parts are opened, since a greater number of refrigerant passages 101 and 105 is provided at the inlet-side of the first evaporator 150 when compared to that of inlet-side refrigerant passages 103 of the second evaporator 160, a relatively large amount of refrigerant may flow into (or to) the first evaporator 150 when compared to the second evaporator 160. As a result, the refrigerant concentration into the first evaporator 150 (for example, the refrigerating compartment evaporator 150) may occur.

For example, when the refrigerating compartment operation mode is performed, the refrigerant may be supplied into the first evaporator 150. The valve device 130 may be controlled so that the refrigerant is divided and supplied into (or to) the first and third refrigerant passages 101 and 105. That is, the valve device 130 may operate to open two discharge parts connected to the first and third refrigerant passages 101 and 105.

When the two discharge parts connected to the first and third refrigerant passages 101 and 105 are opened, the flow of the refrigerant into the second evaporator 160 may be restricted, and the refrigerant may flow into the first evaporator 150. As a result, the refrigerant concentration into the first evaporator 150 (for example, the refrigerating compartment evaporator 150) may occur.

For example, when the refrigerating compartment operation mode is performed, the refrigerant may be supplied into the first and second evaporators 150 and 160. The valve device 130 may be controlled so that the refrigerant is divided and supplied into the second and third refrigerant passages 103 and 105. That is, the valve device 130 may operate to open two discharge parts connected to the second and third refrigerant passages 103 and 105.

When the two discharge parts connected to the second and third refrigerant passages 103 and 105 are opened, the refrigerant may flow into the first and second evaporators 150 and 160. An amount of refrigerant introduced into the second evaporator 160 may be greater than that of refrigerant introduced into the second evaporator 160 when all of the first to third refrigerant passages 101, 103, and 105 are opened.

As described above, the refrigerant may be divided (or separated) into at least two refrigerant passages of the first to third refrigerant passages 101, 103, and 105 to flow. The third refrigerant passage 105 may operate to be always opened.

Each of the first to third expansion devices 141, 143, and 145 may have a diameter that is determined as an adequate value to control an amount of refrigerant to be divided (i.e., an amount of refrigerant concentrated into the first or second evaporator 150 or 160). As the expansion device increases in diameter, an amount of refrigerant flowing into the refrigerant passage disposed in the expansion device may increase.

For example, the third expansion device 145 may have a diameter less than that of the first or second expansion device 141 or 143.

In this example, in the simultaneous operation mode, all of the first to third refrigerant passages 101, 103, and 105 may be opened, and more amount of refrigerant may be divided to flow into the first evaporator 150 than the second evaporator 160. It may be determined that the refrigerant concentration into the first evaporator 150 occurs.

In the refrigerating compartment operation mode, the first and third refrigerant passages 101 and 105 may be opened, and the flow of the refrigerant into the second evaporator 160 may be restricted. Thus, the refrigerant may flow into the first evaporator 150. It may be determined that the refrigerant concentration into the first evaporator 150 occurs.

In the freezing compartment operation mode, the second and third refrigerant passages 103 and 105 may be opened, and the second expansion device 143 may have a diameter greater than that of the third expansion device 145. Thus, a greater amount of refrigerant may be divided (or separated) to flow into the first evaporator 150 than the second evaporator 160. It may be determined that the refrigerant concentration into the second evaporator 160 occurs.

Since a predetermined amount of refrigerant is introduced into the first evaporator and then evaporated regardless of the operation mode of the refrigerator, the cooling operation of the storage compartment in which the first evaporator 150 is disposed (i.e., the refrigerating compartment) may be performed for a predetermined time. Thus, a phenomenon in which the inner temperature of the refrigerating compartment significantly increases, particularly, a phenomenon in which the inner temperature of the refrigerating compartment significantly increases during the freezing compartment operation mode may be prevented.

The refrigerator 10 may include blower fans 125, 155, and 165 disposed on one side of the heat exchanger to blow air. The blower fans 125, 155, and 165 includes a condensation fan 125 provided on one side of the condenser 120, a first evaporation fan 155 provided on one side of the first evaporator 150, and a second evaporation fan 165 provided on one side of the second evaporator 160.

Each of the first and second evaporators 150 and 160 may vary in heat-exchange performance according to a rotation rate of each of the first evaporation fans 155 and 165. For example, if a large amount of refrigerant is required according to the operation of the evaporator 150, the first evaporation fan 155 may increase in rotation rate (or have an increased rate). Additionally, if cool air is sufficient, the first evaporation fan 155 may be reduced in rotation rate (or have a decreased rate).

The refrigerator 10 may further include the supercooling heat exchanger 200 for supercooling the refrigerant to be introduced into (or to) the first or second evaporator 150 and 160. The supercooling heat exchanger 200 may be disposed at an outlet side of the dryer 180, and the refrigerant passing through the dryer 190 may be introduced into (or to) the supercooling heat exchanger 200.

The supercooling heat exchanger 200 may include the refrigerant tube 100 through which the refrigerant passing through the dryer 180 flows and a heat exchanger in which the refrigerant of the refrigerant tube 100 is heat-exchanged with the refrigerant of the third refrigerant passage 105. Since the third refrigerant passage 105 is the branch passage of the refrigerant tube 100, the refrigerant tube 100 that is a main tube and the third refrigerant passage 105 that is a branch tube may be heat-exchanged with each other.

Since the refrigerant of the third refrigerant passage 105 is decompressed in the third expansion device 145, the refrigerant of the third refrigerant passage 105 may have a pressure less than that of the refrigerant of the refrigerant tube 100. Thus, while the refrigerant is heat-exchanged in the supercooling heat exchanger 200, the refrigerant of the third refrigerant passage 105 may be evaporated, and the refrigerant of the refrigerant tube 100 may be supercooled.

The third refrigerant passage 105 may be connected to the first refrigerant passage 101 via the supercooling heat exchanger 200. That is, the third refrigerant passage 105 passing through the supercooling heat exchanger 200 may be connected to the first refrigerant passage 101 of the outlet-side of the first expansion device 141. Thus, the refrigerant of the third refrigerant passage 105, which is evaporated in the supercooling heat exchanger 200 may be mixed (or separated) with the refrigerant decompressed in the first expansion device 141 and then be introduced into the first evaporator 150.

The refrigerant of the refrigerant tube 100, which is supercooled while passing through the supercooling heat exchanger 200 may be introduced into the valve device 130, and the first to third refrigerant passages 101, 103, and 105 may be branched into (or to) at least two refrigerant passages.

As a result, the refrigerant condensed in the condenser 120 may be supercooled and then be introduced into (or to) the valve device 130. The refrigerant may be decompressed in the first to third refrigerant passages 101, 103, and 105 and the first to third expansion devices 141, 143, and 145 and then be introduced into (or to) the first evaporator 150 and the second evaporator 160 to increase an evaporation capacity and improve system efficiency (see FIG. 6).

Figure 5:
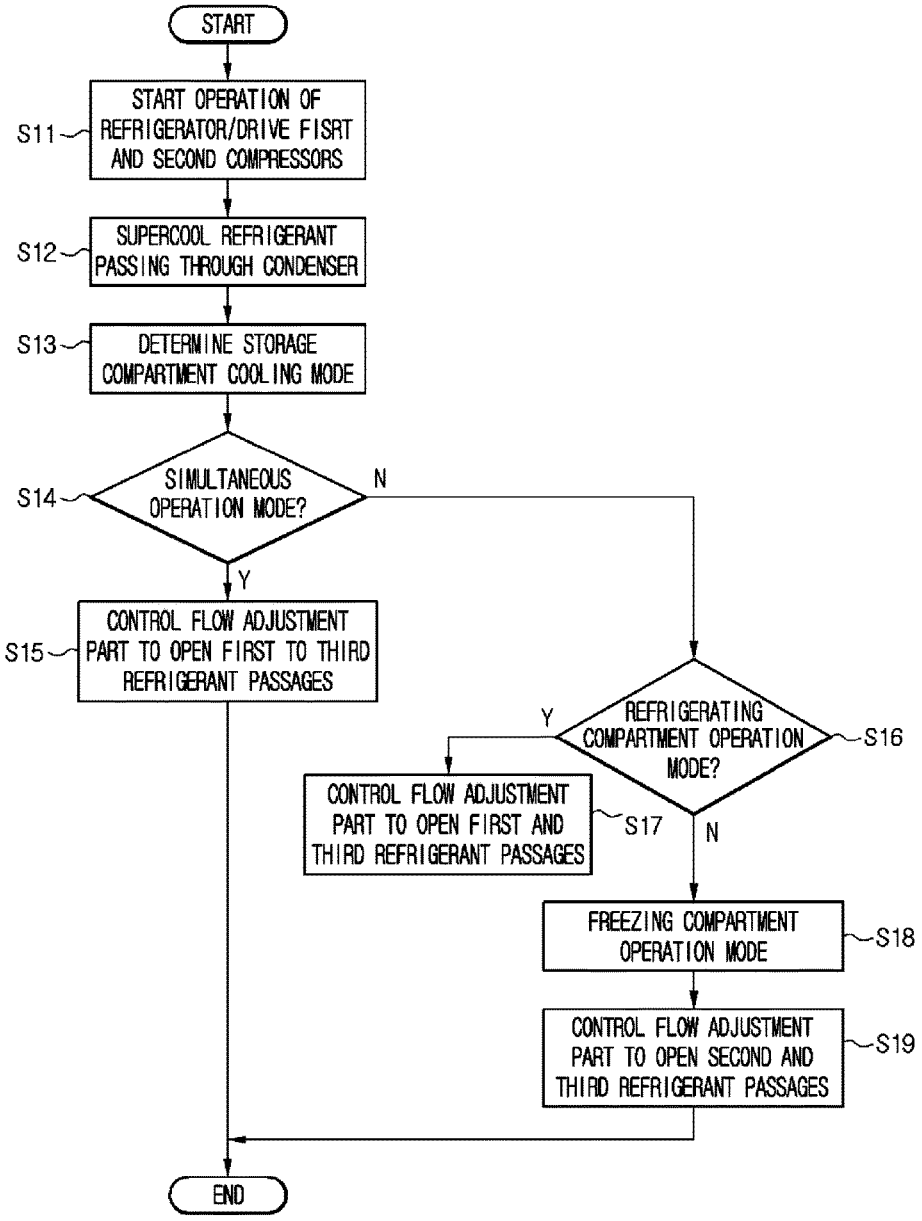
FIG. 5 is a flowchart illustrating a method for controlling the refrigerator according to the first embodiment.

FIG. 5 is a flowchart illustrating a method for controlling the refrigerator according to the first embodiment. Other embodiments and configurations may be provided.

When an operation of a refrigerator starts, first or second compressor 111 or 115 may operate to allow a refrigerant to be circulated into a refrigeration cycle. For example, when the refrigerator operates in a simultaneous operation mode, the first and second compressors 111 and 115 may operate together with each other. When the refrigerator operates in a refrigerating compartment operation mode, only the first compressor 111 may operate. The refrigerator operates in a freezing compartment operation mode, the first and second compressors 111 and 115 may operate together with each other, or only the first compressor 111 may operate (S11).

The refrigerant may circulate into the refrigeration cycle according to operation of the first or second compressor 111 or 115. The refrigerant passing through a condenser 120 may be supercooled while passing through the supercooling heat exchanger 200 (S12).

The cooling mode of the storage compartment (i.e., the operation mode of the refrigerator) may be determined. The operation mode of the refrigerator may change during operation of the refrigerator (S13).

When the refrigerator operates in the simultaneous operation mode, a valve device (i.e., first to third refrigerant passages 101, 103, and 105 through the control of the valve device 130) may be opened.

When the first to third refrigerant passages 101, 103, and 105 are opened, the refrigerant flowing into the first refrigerant passage 101 may be decompressed in a first expansion device 141 and then be introduced into (or to) the first evaporator 150. The refrigerant flowing into the second refrigerant passage 103 may be decompressed in the second expansion device 143 and then be introduced into (or to) the second evaporator 160.

The refrigerant flowing into the third refrigerant passage 105 may be decompressed in the third expansion device 145 to pass through the supercooling heat exchanger 200 and then be mixed with the refrigerant of the first refrigerant passage 101. The refrigerant of the refrigerant tube 100, which is heat-exchanged with the third refrigerant passage 105, may be supercooled and then be introduced into the valve device 130 (S14 and S15).

On the other hand, when the refrigerator operates in the refrigerating compartment operation mode, the valve device 130 (i.e., the first and third refrigerant passages 101 and 105 through the control of the valve device 130) may be opened.

When the first and third refrigerant passages 101 and 105 are opened, the refrigerant flowing into the first refrigerant passage 101 may be decompressed in the first expansion device 141 and then be introduced into (or to) the first evaporator 150. The flow of the refrigerant into the second refrigerant passage 103 may be restricted.

The refrigerant flowing into the third refrigerant passage 105 may be decompressed in the third expansion device 145 to pass through the supercooling heat exchanger 200 and then be mixed with the refrigerant of the first refrigerant passage 101. The refrigerant of the refrigerant tube 100, which is heat-exchanged with the third refrigerant passage 105, may be supercooled and then be introduced into (or to) the valve device 130 (S16 and S17).

When the refrigerator operates in the freezing compartment operation mode, the valve device 130 (i.e., the second and third refrigerant passages 103 and 105 through the control of the valve device 130) may be opened.

When the second and third refrigerant passages 103 and 105 are opened, the refrigerant flowing into the second refrigerant passage 103 may be decompressed in the second expansion device 143 and then be introduced into the second evaporator 160. The refrigerant flowing into the third refrigerant passage 105 may be decompressed in the third expansion device 145 to pass through the supercooling heat exchanger 200 and then be introduced into the first refrigerant passage 101. The refrigerant of the first refrigerant passage 101 may be introduced into the first evaporator 150 and then be evaporated.

As a result, even though a discharge part connected to the first refrigerant passage 101 of three discharge parts of the valve device 130 is not opened, the refrigerant may flow into the first refrigerant passage 101 via the third refrigerant passage 105. Thus, operation of the first evaporator 150 may be performed. The refrigerant of the refrigerant tube 100, which is heat-exchanged with the third refrigerant passage 105, may be supercooled and then be introduced into (or to) the valve device 130 (S16 and S17).

According to the above-described control method, since the refrigerant condensed in the condenser 120 is supercooled, an evaporation capacity in the evaporator may increase to improve operation efficiency of the refrigerator. Since the storage compartment in which the first evaporator 150 is disposed (for example, the refrigerating compartment does not significantly increase in temperature) a temperature deviation in the refrigerating compartment of the refrigerator may be reduced.

Figure 6:
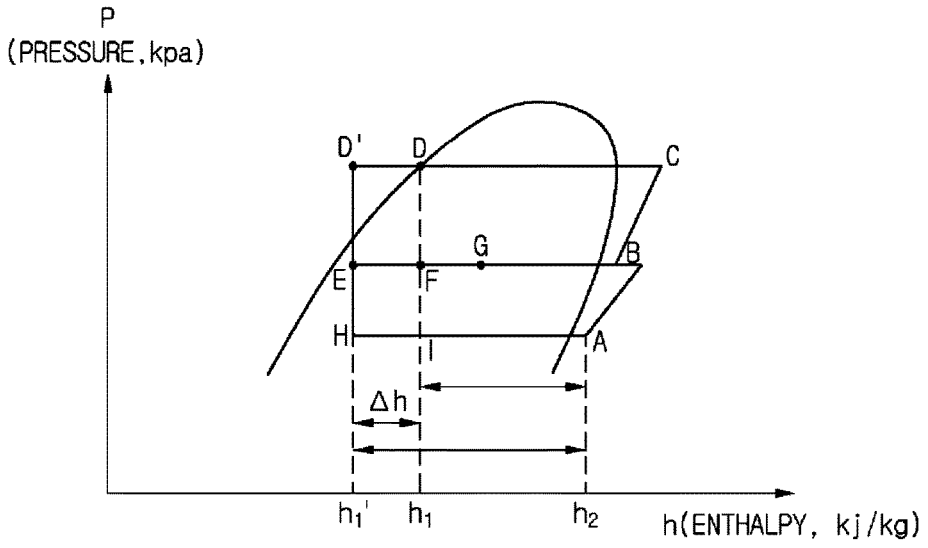
FIG. 6 is a graph illustrating a P-H diagram of a refrigerant circulated into the refrigerator according to the first embodiment.

FIG. 6 is a graph illustrating a P-H diagram of a refrigerant circulated into the refrigerator according to the first embodiment. Other embodiments and configurations may also be provided.

Referring to FIGS. 4 to 6, if the supercooling heat exchanger 200 is not provided, a refrigerant in a refrigerant cycle may be circulated in order of points A→B→C→D→F→I.

A point A state refrigerant suctioned into the second compressor 115 may be a point B state refrigerant after being compressed, and the refrigerant compressed in the first compressor 111 may be a point C state refrigerant. The refrigerant condensed in the condenser 120 may be a point D state refrigerant.

The refrigerant, which is decompressed in the first expansion device 141, and the refrigerant, which is decompressed in the third expansion device 145, of the refrigerant passing through the valve device 130 may be a point F state refrigerant. The refrigerant evaporated in the first evaporator 150 may be the point B state refrigerant.

The refrigerant decompressed in the second expansion device 143 of the refrigerant passing through the valve device 130 may be a point I state refrigerant, and the refrigerant evaporated in the second evaporator 160 may be the point A state refrigerant.

In the refrigerant cycle according to disadvantageous arrangements, an evaporation capacity in the first and second evaporators 150 and 160 may correspond to an enthalpy difference h2−h1.

On the other hand, when the supercooling heat exchanger 200 according to the first embodiment is provided, a refrigerant in the refrigerant cycle may be circulated in order of points A→B→C→D→D'→E→H.

The point A state refrigerant suctioned into the second compressor 115 may be the point B state refrigerant after being compressed, and the refrigerant compressed in the first compressor 111 may be the point C state refrigerant. The refrigerant condensed in the condenser 120 may be the point D state refrigerant.

The refrigerant supercooled while passing through the supercooling heat exchanger 200 may be a point D' state refrigerant. The point D' state refrigerant may be introduced into the valve device 130. The refrigerant flowing into the third refrigerant passage 105 may be decompressed in the third expansion device 145 to become a point F state refrigerant and also become a point G state refrigerant while passing through the supercooling heat exchanger 200.

The refrigerant decompressed in the first expansion device 141 of passing through the valve device 130 may be a point E state refrigerant. The point E state refrigerant may be mixed with the point G state refrigerant of the third refrigerant passage 105 and then be introduced into the first evaporator 150. The refrigerant evaporated in the first evaporator 150 may be the point B state refrigerant.

The refrigerant decompressed in the second expansion device 143 of the refrigerant passing through the valve device 130 may be a point H state refrigerant, and the refrigerant evaporated in the second evaporator 160 may be the point A state refrigerant.

In the refrigerant cycle, an evaporation capacity in the first and second evaporators 150 and 160 may correspond to an enthalpy difference h2−h1'. Since the enthalpy difference h2−h1' is greater than the enthalpy difference h2−h1, the evaporation capacity may increase by about Δh when compared to disadvantageous arrangements.

The operation performance of the refrigerant may be improved to relatively reduce power consumption in comparison to the same operation performance. As a result, operation efficiency of the refrigerant may be improved.

A description may hereafter be made according to a second embodiment. The embodiment may be the same as the first embodiment except for only a portion of the constitutions, and thus their different points may be mainly described.

Figure 7:
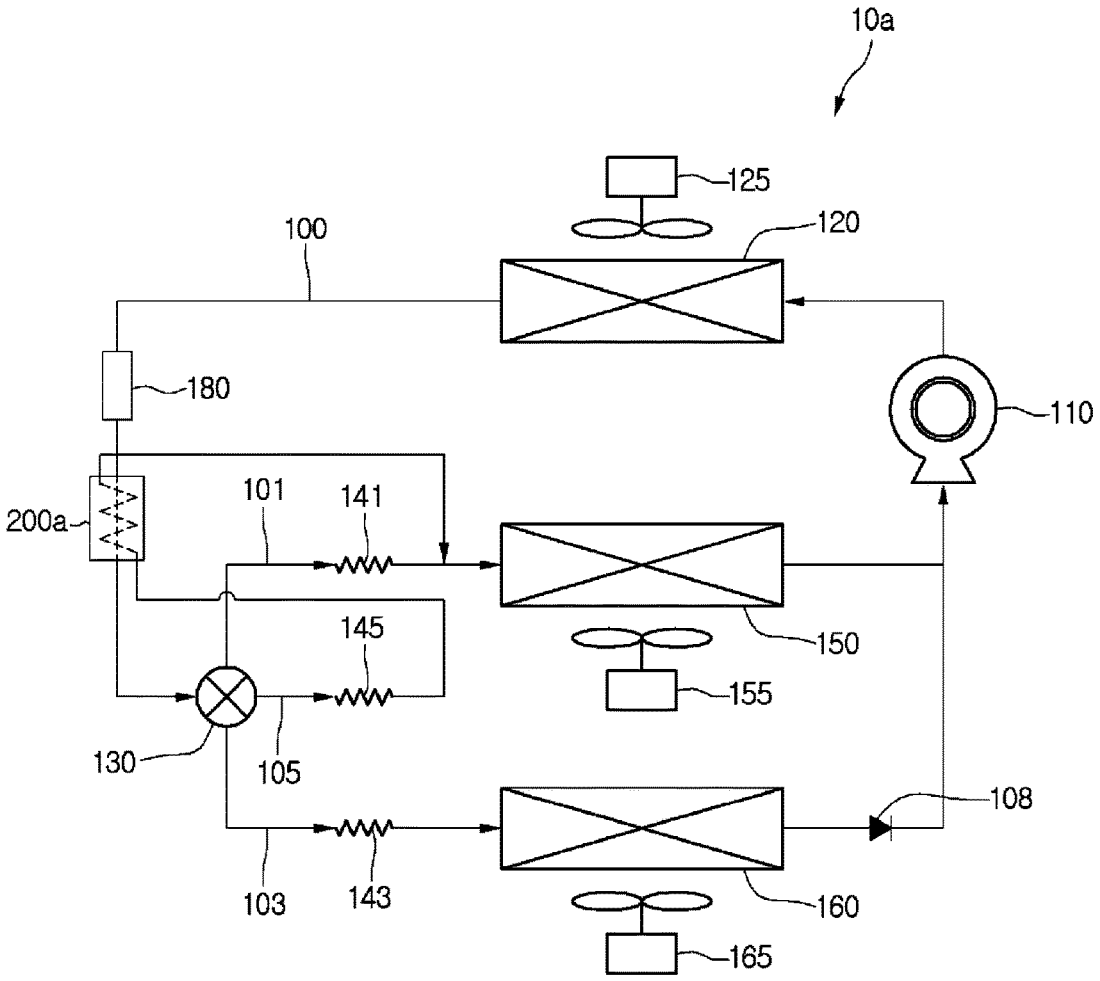
FIG. 7 is a view illustrating a system having a refrigeration cycle in a refrigerator according to a second embodiment.

FIG. 7 is a view illustrating a system having a refrigeration cycle in a refrigerator according to a second embodiment. Other embodiments and configurations may also be provided.

Referring to FIG. 7, a refrigerator 10*a* according to a second embodiment includes a plurality of devices for driving a refrigeration cycle.

The refrigerator 10*a* may include one compressor 110 for compressing a refrigerant, the condenser 120 for condensing the refrigerant compressed in the compressor 110, the plurality of expansion devices 141, 143, and 145 for decompressing the refrigerant condensed in the condenser 120, and the plurality of evaporators 150 and 160 for evaporating the refrigerant decompressed in the plurality of expansion devices 141, 143, and 145.

The refrigerator may include the refrigerant tube 100 connecting the compressor 110, the condenser 120, the expansion devices 141, 143, and 145, and the evaporators 150 and 160 to each other to guide a flow of the refrigerant.

Descriptions with respect to elements such as the condenser 120, the plurality of expansion devices 141, 143, and 145, the plurality of evaporators 150 and 160, the dryer 180, the refrigerant tube 100, the valve device 130, first to third refrigerant passages 101, 103, and 105, and the first to third expansion devices 141, 143, and 145 may be understood with respect to the first embodiment.

The refrigerator 10*a* may further include a supercooling heat exchanger 200*a*. A refrigerant of the refrigerant tube 100, which passes through the condenser 120 and a refrigerant of the third refrigerant passage 105 may be heat-exchanged with each other. In this process, the refrigerant of the refrigerant tube 100 may be supercooled. The expected effects may be the same as those described in the first embodiment.

The refrigerant evaporated in the first evaporator 150 and the refrigerant evaporated in the second evaporator 160 may be mixed with each other and then be suctioned into the one compressor 110.

A check valve 108 for guiding the refrigerant in one direction may be disposed at the outlet-side of the second evaporator 160. The check valve 108 may guide the refrigerant passing through the second evaporator 160 into the compressor 110 and restrict an opposite flow of the refrigerant. The check valve 108 may restrict a flow of the refrigerant passing through the first evaporator 150 into the second evaporator 160. The refrigerant passing through the first and second evaporators 150 and 160 may be suctioned into the compressor 110.

Therefore, the refrigerator according to the current embodiment may be simplified in structure and reduced in manufacturing costs when compared to those of the refrigerator including the plurality of compressors 111 and 115 according to the first embodiment.

A description may now be made according to a third embodiment. The current embodiment relates to a control technology for controlling an amount of refrigerant to be introduced into a first or second evaporator. The components constituting the cycle of the refrigerator may be understood with respect to the descriptions of FIG. 4.

Figure 8:
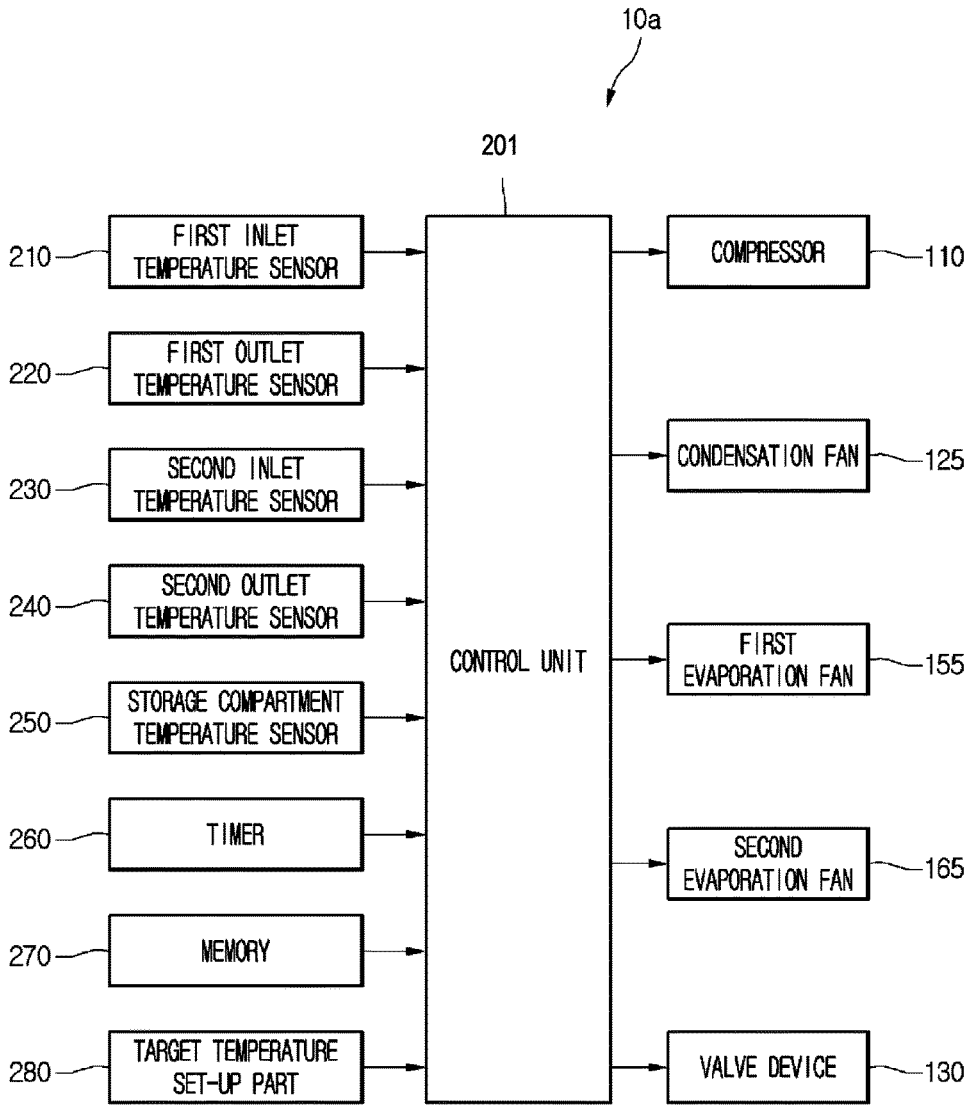
FIG. 8 is a block diagram illustrating constitutions of a refrigerator according to a third embodiment.
Figure 9:
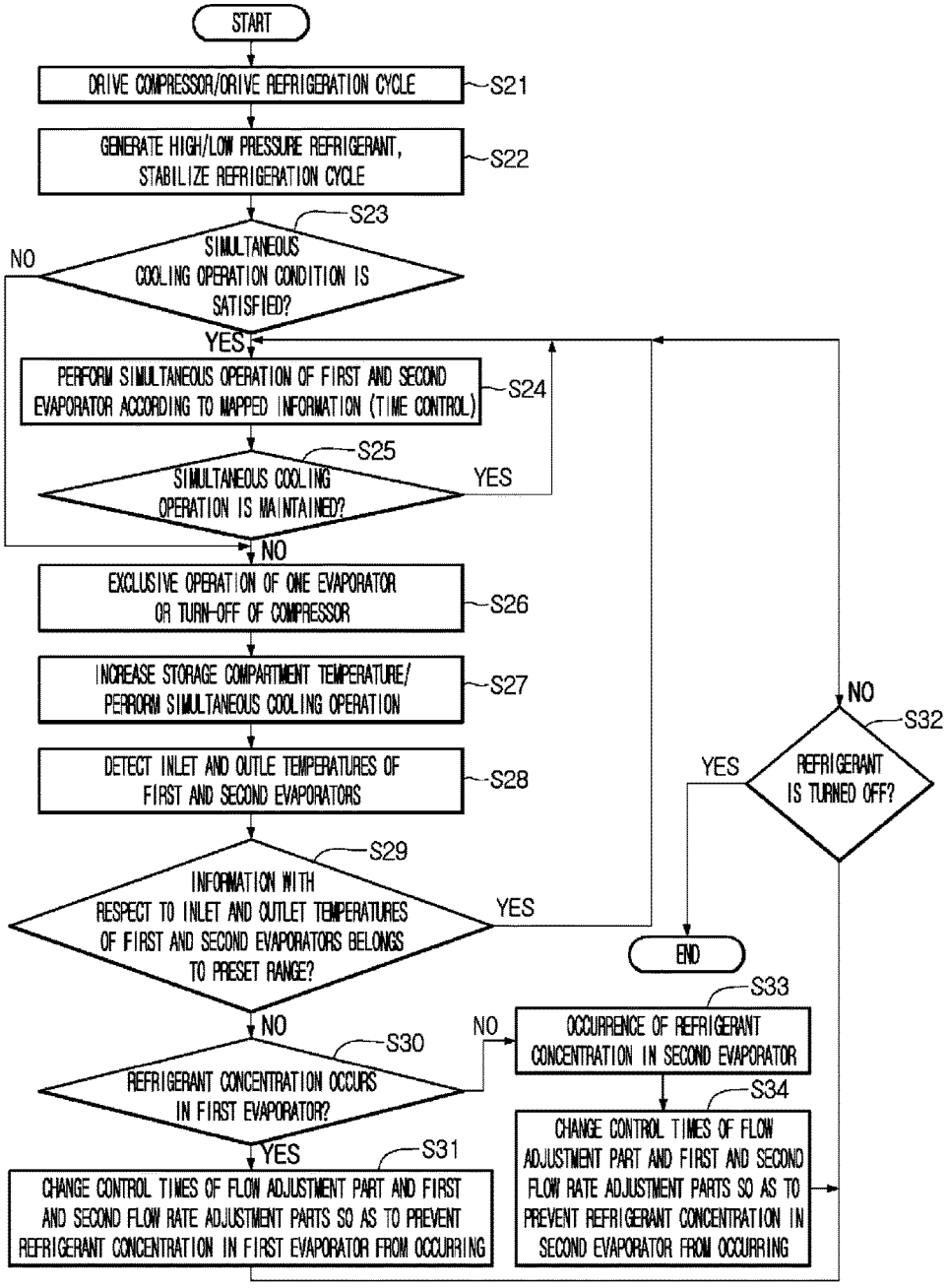
FIG. 9 is a flowchart illustrating a method for controlling the refrigerator according to the third embodiment.

FIG. 8 is a block diagram illustrating constitutions of a refrigerator according to a third embodiment. FIG. 9 is a flowchart illustrating a method for controlling the refrigerator according to the third embodiment. Other embodiments and configurations may also be provided.

Referring to FIG. 8, the refrigerator 10 according to the current embodiment may include a plurality of temperature sensors 210, 220, 230, and 240 for detecting inlet or outlet temperatures of each of the first and second evaporators 150 and 160.

The plurality of temperature sensors 210, 220, 230, and 240 include a first inlet temperature sensor 210 for detecting an inlet-side temperature of the first evaporator 150 and a first outlet temperature sensor 220 for detecting an outlet-side temperature of the first evaporator 150.

The plurality of temperature sensors 210, 220, 230, and 240 may include a second inlet temperature sensor 230 for detecting an inlet-side temperature of the second evaporator 160 and a second outlet temperature sensor 240 for detecting an outlet-side temperature of the second evaporator 160.

The refrigerator 10 may further include a control unit 201 for controlling an operation of a valve device 130 based on the temperatures detected by the plurality of temperature sensors 210, 220, 230, and 240.

To perform simultaneous cooing operations of the refrigerating and freezing compartments, the control unit 201 may control operations of the compressor 110, the condensation fan 125, and the first and second evaporation fans 155 and 165. The compressor 110 may include the first compressor 111 and the second compressor 115.

The refrigerator may include a storage compartment temperature sensor 250 for detecting an inner temperature of the refrigerator storage compartment. The storage compartment temperature sensor includes a refrigerating compartment temperature sensor disposed in the refrigerating compartment to detect an inner temperature of the refrigerating compartment and a freezing compartment temperature sensor disposed in the freezing compartment to detect an inner temperature of the freezing compartment.

The refrigerator may include a target temperature set-up part 280 for inputting a target temperature of the refrigerating compartment or the freezing compartment. For example, the target temperature set-up part 280 may be disposed on a position that is easily manipulated by a user on a front surface of the refrigerating compartment door or the freezing compartment door.

The information inputted through the target temperature set-up part 280 may become control reference information of the compressor 110, the plurality of blower fans 125, 155, and 165, and the valve device 130. That is, the control unit 201 may determine the simultaneous cooling operation of the refrigerating compartment and the freezing compartment, an exclusive operation of one storage compartment, or turn-off of the compressor 110 based on the information inputted by the target temperature set-up part 280 and the information detected by the storage compartment temperature sensor 250.

For example, if the inner temperatures of the refrigerating compartment and the freezing compartment are higher than that inputted by the target temperature set-up part 280, the control unit 201 may control the compressor 110 and the valve device 130 to perform the simultaneous cooling operation.

On the other hand, if the inner temperature of the freezing compartment is higher than that inputted by the target temperature set-up part 280, and the inner temperature of the refrigerating compartment is lower than that inputted by the target temperature set-up part 280, the control unit 201 may control the compressor 110 and the valve device 130 to perform an exclusive cooling operation for the freezing compartment.

When the inner temperatures of the refrigerating compartment and the freezing compartment are lower than that inputted by the target temperature set-up part 280, the control unit 201 may turn the compressor 110 off.

The refrigerator may further include a timer 260 for integrating a time elapsing value for operation of the valve device 130 while the simultaneous cooling operation of the refrigerating compartment and the freezing compartment is performed. For example, the timer 240 may integrate a time that elapses in a state where all of the first and third refrigerant passages 101 and 105 are opened or a time that elapses in a state where one of the first and third refrigerant passages 101 and 105 is opened.

The refrigerator 10 may further include a memory unit (or memory 270) for mapping time values with respect to the adjusted state of the valve device 130 to previously store the mapped values while the simultaneous cooling operation of the refrigerating compartment and the freezing compartment is performed.

In the current embodiment, information mapped as shown in Table 1 below may be stored in the memory 270.

TABLE 1

| Refrigerant concentration | Case 1 | Case 2 |
|---|---|---|
| Simultaneous cooling operation start (reference value) | 90 seconds | 90 seconds |
| When refrigerant concentration occurs in first evaporator | 90 seconds | 120 seconds |
| When refrigerant concentration occurs in second evaporator | 90 seconds | 60 seconds |

Referring to Table 1 above, the "case 1" may be understood as a first control state (an adjusted state) of the valve device 130 (i.e., a state in which an amount of refrigerant flowing into the first refrigerant passage 150 is greater than that of refrigerant flowing into the second refrigerant passage 160). The valve device 130 may be controlled to open all of the first to third refrigerant passages 101, 103, and 105.

On the other hand, the "case 2" may be a first control state (an adjusted state) of the valve device 130 (i.e., a state in which an amount of refrigerant flowing into the second refrigerant passage 160 is greater than that of refrigerant flowing into the first refrigerant passage 150). The valve device 130 may be controlled to open all of the second and third refrigerant passages 103 and 105.

For example, if the simultaneous cooling operation conditions are satisfied, it may be determined that the cooling operation is required for all of the refrigerating compartment and the freezing compartment. Thus, the simultaneous cooling operation may start. The control unit 201 may maintain the first control state for approximately 90 seconds, and then maintain the second control state for approximately 90 seconds. The first and second control states may be alternately performed if it is unnecessary to perform the simultaneous cooling operation.

While the first and second control states are repeatedly performed, when the inner temperature of the refrigerating compartment or the freezing compartment reaches a target temperature, the supply of the refrigerant into at least one evaporator may be stopped (exclusive one evaporator operation). When all of the inner temperatures of the refrigerating compartment and the freezing compartment reach the target temperature, the compressor 110 may be turned off.

When the exclusive one evaporator operation or the turn-off of the compressor 110 are maintained for a predetermined time, and it is needed to perform the simultaneous cooling operation of the refrigerating compartment and the freezing compartment, the control unit 201 may determine whether refrigerant concentration in the first or second evaporator 150 or 160 occurs based on the temperature values detected by the temperature sensors 210, 220, 230, and 240.

If it is determined that the refrigerant concentration in the first evaporator 150 occurs, then the control unit 201 may change the time values according to the first and second cases 1 and 2 to apply the changing time values. That is, when the refrigerant concentration in the first evaporator 150 occurs, since a time for supplying the refrigerant into the second evaporator 160 has to relatively increase, a control time with respect to the case 2 may increase (approximately 120 seconds).

On the other hand, when the refrigerant concentration in the second evaporator occurs, since a time taken to supply the refrigerant into the first evaporator 150 has to relatively increase, a control time with respect to the case 2 may decrease (approximately 60 seconds).

That is, if it is determined that the refrigerant concentration in one evaporator occurs, the control time with respect to the case 2 may be adjusted to prevent the refrigerant concentration in the evaporator from occurring. It may be determined that a cooling load of the storage compartment in which the second evaporator 160 is disposed is less than that of the storage compartment in which the first evaporator 150 is disposed.

As a result, the control time with respect to the case 1 for increasing the supply of the refrigerant into the storage compartment having the relatively large cooling load may be fixed, and the control time with respect to the case 2 for increasing the supply of the refrigerant into the storage compartment having the relatively small cooling load may be changed. Thus, the storage compartment having the large cooling load may be stably maintained in cooling efficiency.

The control time of the valve device 130 according to the case 1 is called a "first set-up time", and the control time of the valve device 130 is called a "second set-up time".

In Table 1, the information with respect to the time value for successively performing the cases 1 and 2 while the simultaneous cooling operation is performed and the changing time for successively performing the cases 1 and 2 when the refrigerant concentration in the one evaporator occurs may be obtained through repeated experiments.

Referring to FIG. 9, a method for controlling the refrigerator according to the current embodiment may be described. Other embodiments and configurations may also be provided.

To drive the refrigerator, the first and second compressor 111 and 115 are driven. A refrigeration cycle according to the compression-condensation-expansion-evaporation of the refrigerant may operate according to driving of the compressor 110. The refrigerant evaporated in the second evaporator 160 may be compressed in the second compressor 115, and the compressed refrigerant may be mixed with the refrigerator evaporated in the first evaporator 150, and then the mixture may be suctioned into the first compressor 111 (S21).

The simultaneous cooling operation of the refrigerating compartment and the freezing compartment may be initially performed according to operation of the refrigeration cycle. When a predetermined time elapses, a pressure value according to the refrigerant circulation may reach a preset range. That is, a high pressure of the refrigerant discharged from the first and second compressors 111 and 115 and a low pressure of the refrigerant discharged from the first and second evaporators 150 and 160 may be set within the present range.

When the high and low pressures of the refrigerant are set within the preset range, then the refrigeration cycle may be stabilized to continuously operate. A target temperature of the storage compartment of the refrigerator may be previously set (S22).

While the refrigeration cycle operates, it may be determined whether the simultaneous cooling operation conditions of the refrigerating compartment and the freezing compartment are satisfied. For example, if it is determined that the inner temperature of the refrigerating compartment and the freezing compartment is above the target temperature through the value detected by the storage compartment temperature sensor 250, the simultaneous cooling operation of the refrigerating compartment and the freezing compartment may be performed (S23).

When the simultaneous cooling operation is performed, the simultaneous operation of the first and second evaporators 150 and 160 may be performed according to the previously mapped information. That is, the valve device 130 may be controlled in operation to simultaneously supply the refrigerant into the first and second evaporators 150 and 160.

As described in the first embodiment, at least one portion of the refrigerant to be introduced into the first evaporator 150 may be bypassed to pass through the supercooling heat exchanger 200 and then be introduced into the first evaporator 150.

As shown in Table 1, in the valve device 130, the first adjustment state according to the case 1 may be maintained for approximately 90 seconds, and the second adjustment state according to the case 2 may be maintained for approximately 90 seconds. That is, a time control operation for preventing the refrigerant concentration into the second evaporator 160 from occurring is performed firstly according to the case 1, and then a time control operation for preventing the refrigerant concentration into the first evaporator 150 from occurring is performed according to the case 2 (S24). When the simultaneous cooling operation according to the cases 1 and 2 is performed at least one time, it is determined whether the simultaneous cooling operation of the refrigerating compartment and the freezing compartment has to be maintained. Whether the temperature of the refrigerating compartment or the freezing compartment reaches the target temperature may be detected through the storage compartment temperature sensor 250.

If the temperature of the refrigerating compartment or the freezing compartment reaches the target temperature, it may be unnecessary to perform the cooling of the corresponding storage compartment, and thus it may be unnecessary to perform the simultaneous cooling operation.

When the exclusive cooling operation of the storage compartment, which does not reach the target temperature (i.e., the exclusive cooling operation of the evaporator of the corresponding storage compartment is performed) or all of the storage compartments reach the target temperature, then the compressor 110 may be turned off.

On the other hand, if all of the temperatures of the refrigerating compartment and the freezing compartment do not reach the target temperature, then the process may return to the operation S22 to again perform the simultaneous operation of the first and second evaporators 150 and 160. The simultaneous operation may be repeatedly performed until at least one of the refrigerating compartment and the freezing compartment reaches the target temperature.

As described above, while the simultaneous operation of the first and second evaporators 150 and 160 is performed, the control of the valve device 130 according to the cases 1 and 2 may be successively performed to prevent the refrigerant concentration from occurring in the first and second evaporators 150 and 160, thereby improving cooling efficiency of the storage compartment and operation efficiency of the refrigerator (S25 and S26).

In the operation S26, when a time elapses in the state where the exclusive operation of one evaporator is performed, or the compressor 110 is turned off, the refrigerating compartment and the freezing compartment may increase in temperature.

When the temperature of the refrigerating compartment or the freezing compartment increase to a temperature out of the target temperature range, it may be necessary to cool the storage compartment that increases in temperature or to operate the compressor 110 that is in the turn-off state. The simultaneous cooling operation of the refrigerating compartment and the freezing compartment may be performed again (S27).

While the simultaneous cooling operation is performed again, change in the control time of the valve device 130 according to the cases 1 and 2 may be determined.

The inlet and outlet temperatures of the first evaporator 150 may be detected by the first inlet and outlet temperature sensors 210 and 220. The inlet and outlet temperatures of the second evaporator 160 may be detected by the second inlet and outlet temperature sensors 230 and 240, respectively (S28).

The control unit 201 may determine an inlet/outlet temperature difference value of the first evaporator 150 and an inlet/outlet temperature difference value of the second evaporator 160.

When an amount of refrigerant introduced into the first or second evaporator 150 or 160 is above an adequate refrigerant amount, then the difference value between the inlet and outlet temperatures of the first or second evaporator 150 and 160 may decrease. On the other hand, when an amount of refrigerant introduced into the first or second evaporator 150 or 160 is below the adequate refrigerant amount, then the difference value between the inlet and outlet temperatures of the first or second evaporator 150 or 160 may increase.

The control unit 201 may determine whether information with respect to the difference value between the inlet and outlet temperatures of the first or second evaporator 150 or 160 belongs to a preset range.

That is, the control unit 201 may determine whether an amount of refrigerant flowing into the first or second evaporator 150 or 160 is excessive or lack (i.e., whether the refrigerant is concentrated into the first or second evaporator 150 or 160) based on the inlet/outlet temperature difference of the first evaporator 150 and the inlet/outlet temperature difference of the second evaporator 160.

In detail, whether the amount of refrigerant flowing into the first or second evaporator 150 or 160 is excessive or lack may be determined on the basis of the inlet/outlet temperature difference of the first evaporator 150, the inlet/outlet temperature difference of the second evaporator 160, or a ratio of the inlet/outlet temperature differences of the first and second evaporators 150 and 160 (S29).

The detailed determination method may be described.

As an example of the determination method, it may be determined whether the refrigerant is concentrated according to whether the inlet/outlet temperature difference of the first evaporator 150 is equal to or greater or less than a preset reference value.

The refrigerant circulated into the refrigeration cycle may be branched into the first and second evaporators 150 and 160 through the flow adjusting part 130 to flow. Thus, when the inlet/outlet temperature difference of the first evaporator 150 is detected, a rate of the refrigerant passing through the first evaporator 150 may be determined. A rate of the refrigerant passing through the second evaporator 160 may be determined based on the rate of the refrigerant passing through the first evaporator 150.

For example, when the inlet/outlet temperature difference of the first evaporator 150 is greater than the reference value, it may be determined that an amount of refrigerant is lack. On the other hand, it may be recognized that an amount of refrigerant flowing into the second evaporator 160 is relatively large.

A method for determining a refrigerant concentration phenomenon by using the inlet/outlet temperature difference of the first evaporator 150 may be described. The refrigerant concentration phenomenon may also be determined by using the inlet/outlet temperature difference of the second evaporator 160.

If the inlet/outlet temperature difference of the first evaporator 150 is equal to the preset reference value (a reference temperature), it may be determined that the refrigerant concentration into the first or second evaporators 150 or 160 may not occur.

The process may return to the operation S24, and then the valve device 130 may be controlled based on the time value that is set when the simultaneous cooling operation starts. That is, each of the adjusted states according to the cases 1 and 2 may be maintained for approximately 90 seconds. Then, the operations S25 to S28 may be again performed.

If the inlet/outlet temperature difference of the first evaporator 150 is not equal to the preset reference value or is greater or less than the reference value, it may be determined that the refrigerant concentration phenomenon into the first or second evaporator 150 or 160 occurs.

In detail, if the inlet/outlet temperature difference of the first evaporator 150 is less than the preset reference value, it may be determined that a relatively large amount of refrigerant passes through the first evaporator 150. That is, it may be determined that the refrigerant concentration phenomenon into the first evaporator 150 occurs.

This case may correspond to "the occurrence of the refrigerant concentration in the first evaporator" shown in Table 1, and thus, the control state according to the case 1 may be maintained for approximately 90 seconds, and the control state according to the case 2 may increase to approximately 120 seconds. That is, since the adjusting time according to the case 2 increases in preparation for the "simultaneous cooling operation start", an amount of refrigerant introduced into the first evaporator 150 may relatively decrease (S30 and S31).

On the other hand, if the inlet/outlet temperature difference of the first evaporator 150 is greater than the preset reference value, it may be determined that a relatively small amount of refrigerant passes through the first evaporator 150. That is, it may be determined that the refrigerant concentration into the second evaporator 160 occurs.

This case may correspond to "the occurrence of the refrigerant concentration in the first evaporator" shown in Table 1, and thus, the control state according to the case 2 may be maintained for approximately 90 seconds, and the control state according to the case 2 may decrease to approximately 60 seconds. That is, since the adjusting time of the valve device 130 according to the case 2 decreases in preparation for the "simultaneous cooling operation start", an amount of refrigerant introduced into the first evaporator 150 may relatively increase (S33 and S34).

When the control time of the valve device 130 changes by the above-described method, the processes after the operation S24 may be performed again based on the changed control time value unless the refrigerator is turned off (S32).

As described above, since the control time of the valve device 130 changes on the basis of the information with respect to the inlet and outlet temperature difference of the first and second evaporators 150 and 160, the refrigerant concentration in the first and second evaporators 150 and 160 may be prevented.

As another example of the determination method in operation S29, it may be determined whether the refrigerant is concentrated according to whether the inlet/outlet temperature difference of the first evaporator 150 is equal to or is greater or less than a first set value. For example, the first set value may be 1.

When a ratio of the inlet/outlet temperature difference of the first evaporator 150 to the inlet/outlet temperature difference of the second evaporator 160 is 1 (i.e., the inlet/outlet temperature differences of the first and second evaporators 150 and 160 are the same), it may be determined that the refrigerant concentration phenomenon does not occur in the first or second evaporator 150 or 160.

On the other hand, when a ratio of the inlet/outlet temperature difference of the first evaporator 150 to the inlet/outlet temperature difference of the second evaporator 160 is greater than 1 (i.e., the inlet/outlet temperature difference of the first evaporator 150 is greater than that of the second evaporator 160), it may be determined that the refrigerant concentration phenomenon does not occur in the second evaporator 160.

Also, when a ratio of the inlet/outlet temperature difference of the first evaporator 150 to the inlet/outlet temperature difference of the second evaporator 160 is greater than 1, i.e., the inlet/outlet temperature difference of the first evaporator 150 is greater than that of the second evaporator 160, it may be determined that the refrigerant concentration phenomenon does not occur in the second evaporator 150.

As another example of the determination method in the operation S29, it may be determined whether the refrigerant is concentrated according to whether a difference value between the inlet/outlet temperature difference of the first evaporator 150 and the inlet/outlet temperature difference of the second evaporator 160 is equal to a second set value, or is greater or less than the second set value. For example, the first set value may be 0.

When a value obtained by subtracting the inlet/outlet temperature difference of the second evaporator 160 from the inlet/outlet temperature difference of the first evaporator 150 is 0 (i.e., the inlet/outlet temperature differences of the first and second evaporators 150 and 160 are the same), it may be determined that the refrigerant concentration phenomenon does not occur in the first or second evaporator 150 or 160.

On the other hand, when a ratio of the inlet/outlet temperature difference of the first evaporator 150 to the inlet/outlet temperature difference of the second evaporator 160 is greater than 1 (i.e., the inlet/outlet temperature difference of the first evaporator 150 is greater than that of the second evaporator 160), it may be determined that the refrigerant concentration phenomenon does not occur in the second evaporator 160.

When a ratio of the inlet/outlet temperature difference of the first evaporator 150 to the inlet/outlet temperature difference of the second evaporator 160 is less than 0 (i.e., the inlet/outlet temperature difference of the first evaporator 150 is less than that of the second evaporator 160), it may be determined that the refrigerant concentration phenomenon does not occur in the first evaporator 150.

As described, since the opening degree of the valve device 130 is controlled to adjust an amount of refrigerant passing through the first and second refrigerant passages 101 and 103, the refrigerant concentration into the first or second evaporator 150 or 160 may be prevented to improve the cooling efficiency and reduce power consumption.

According to embodiments, since the evaporators respectively disposed in the refrigerating compartment and the freezing compartment simultaneously operate, the simultaneous cooling of the refrigerating compartment and the freezing compartment may be effectively performed. Thus, cooling loss due to alternating operation of the refrigerating compartment and the freezing compartment may be prevented to minimize the temperature deviation of the refrigerant.

The number of refrigerant passages connected to the inlet-side of the first evaporator may be greater than that of refrigerant passages connected to the inlet-side of the second evaporator, and the expansion device may be disposed in each of the refrigerant passages to control the flow of the refrigerant.

At least one portion of the refrigerant discharged through the outlet-side of the condenser may be divided, and then the divided refrigerant may be decompressed to supercool the refrigerant introduced into the inlet-side of the first or second evaporator, thereby improving system efficiency and reducing the power consumption.

Even though the exclusive operation of the second evaporator is performed, since a portion of the refrigerant is introduced into the first evaporator after passing through the supercooling heat exchanger, the cooling of the first evaporator-side storage compartment may be performed.

Since an amount of refrigerant supplied into the plurality of evaporators is adjustable on the basis of the previously determined time value and the inlet and outlet temperature difference of the plurality of evaporators while the refrigerant operates, the distribution of the refrigerant into the plurality of evaporators may be effectively realized.

As a result, the first control process for increasing an amount of refrigerant supplied into one evaporator of the plurality of evaporators and the second control process for increasing an amount of refrigerant supplied into the other evaporator of the plurality of evaporators may be basically performed according to the time period that is set during the simultaneous cooling operation.

Since the inlet and outlet temperature information of the first and second evaporators are confirmed to change the control time values in the first and second control processes, the refrigerant concentration into a specific evaporator of the plurality of evaporators may be prevented to realize the precision control.

Embodiments may provide a refrigerator in which a simultaneous operation of a refrigerating compartment and freezing compartment is performed to improve system efficiency and a method for controlling the same.

In one embodiment, a refrigerator includes: a compressor for compressing a refrigerant; a condenser for condensing the refrigerant compressed in the compressor; a refrigerant tube for guiding the refrigerant condensed in the condenser; a flow adjustment part coupled to the refrigerant tube to divide the refrigerant into a plurality of refrigerant passages; a plurality of expansion devices respectively disposed in the plurality of refrigerant passages to decompress the refrigerant condensed in the condenser; a plurality of evaporators evaporating the refrigerant decompressed in the plurality of expansion devices; and a supercooling heat exchanger disposed at an outlet-side of the condenser to supercool the refrigerant, wherein the refrigerant supercooled in the supercooling heat exchanger is introduced into the flow adjustment part.

The supercooling heat exchanger may be configured to heat-exchange the refrigerant of the refrigerant tube, which passes through the condenser, with the refrigerant flowing into one refrigerant passage of the plurality of refrigerant passages.

The one refrigerant passage may be combined with the other refrigerant passage of the plurality of refrigerant passage after passing through the supercooling heat exchanger.

The plurality of evaporators may include a first evaporator for cooling a refrigerating compartment, and a second evaporator for cooling a freezing compartment.

The plurality of refrigerant passages may include: a first refrigerant passage guiding introduction of the refrigerant into the first evaporator; a second refrigerant passage guiding introduction of the refrigerant into the second evaporator; and a third refrigerant passage guiding introduction of the refrigerant into the first evaporator, the third refrigerant passage passing through the supercooling heat exchanger, wherein the flow adjustment part may include a four-way valve.

The plurality of expansion devices may include: a first expansion device disposed in the first refrigerant passage; a second expansion device disposed in the second refrigerant passage; and a third expansion device disposed in the third refrigerant passage, wherein at least one expansion device of the first to third expansion devices may include a capillary tube.

The compressor may include a first compressor disposed at an outlet-side of the first evaporator, and a second compressor disposed at an outlet-side of the second evaporator.

The flow adjustment part may operate to open at least two refrigerant passages of the first to third refrigerant passages according to an operation mode.

The refrigerator may further include: a temperature sensor detecting inlet and outlet temperatures of the first evaporator or inlet and outlet temperatures of the second evaporator; a memory mapping information with respect to a control time of the flow adjustment part to store the mapped information; and a control unit controlling the flow adjustment part to simultaneously supply the refrigerant into the first and second evaporators on the basis of the mapped information stored in the memory, wherein the control unit may determine a change in control time of the flow adjustment part on the basis of the information detected by the temperature sensor.

The information with respect to the control time of the flow adjustment part may include: information with respect to a first set-up time at which an amount of refrigerant supplied into the first evaporator increases to prevent the refrigerant from being concentrated into the second evaporator; and information with respect to a second set-up time at which an amount of refrigerant supplied into the second evaporator to prevent the refrigerant from being concentrated into the first evaporator.

The control unit may increase the second set-up time when it is determined that the refrigerant concentration into the first evaporator and decrease the second set-up time when it is determined that the refrigerant concentration into the second evaporator according to the information detected by the temperature sensor.

The flow adjustment part may be controlled to open the first to third refrigerant passages for a first set-up time, thereby increasing the mount of refrigerant supplied into the first evaporator and be controlled to open the first and second refrigerant passages for a second set-up time, thereby increasing the amount of refrigerant supplied into the second evaporator.

In another embodiment, a method for controlling a refrigerator including a compressor, a condenser, a refrigerating compartment-side evaporator, and a freezing compartment-side evaporator. The method may include operating the compressor to drive a refrigeration cycle and supercooling a refrigerant passing through the condenser by allowing the refrigerant to pass through a supercooling heat exchanger; and controlling a flow adjustment part disposed at an outlet-side of the condenser according to an operation mode of the refrigerator, wherein the operation mode of the refrigerator includes a simultaneous operation mode of a refrigerating compartment and a freezing compartment, a refrigerating compartment operation mode, and a freezing compartment operation mode, and the refrigerant passing through the flow adjustment part is divided into at least two refrigerant passages to flow according to the simultaneous operation mode, the refrigerating compartment operation mode, and the freezing compartment operation mode.

A first refrigerant passage may be guiding introduction of the refrigerant into the refrigerating compartment-side evaporator, a second refrigerant passage guiding introduction of the refrigerant into the freezing compartment-side evaporator, and a third refrigerant passage guiding introduction of the refrigerant into the refrigerating compartment-side evaporator and passing through the supercooling heat exchanger may be connected to an outlet-side of the flow adjustment part.

When the simultaneous operation mode is performed, the flow adjustment part may be controlled to open the first to third refrigerant passages.

When the refrigerating compartment operation mode is performed, the flow adjustment part may be controlled to open the first and third refrigerant passages.

When the freezing compartment operation mode is performed, the flow adjustment part may be controlled to open the second and third refrigerant passages.

The method may further include changing an amount of refrigerant supplied into the refrigerating compartment-side evaporator and the freezing compartment-side evaporator according to a set-up time, and determining a change in set-up time on the basis of information with respect to an inlet and outlet temperature difference of the refrigerating compartment-side evaporator and an inlet and outlet temperature difference of the freezing compartment-side evaporator.

The changing of the amount of refrigerant according to the set-up time may include: increasing the amount of refrigerant supplied into the refrigerating compartment-side evaporator for a first set-up time to restrict refrigerant concentration into the freezing compartment-side evaporator; and increasing the amount of refrigerant supplied into the freezing compartment-side evaporator for a second set-up time to restrict refrigerant concentration into the refrigerating compartment-side evaporator.

The determining of the change in set-up time may include determining whether the refrigerant concentration into the refrigerating compartment-side evaporator or the freezing compartment-side evaporator occurs, and whether the refrigerant concentration into the refrigerating compartment-side evaporator or the freezing compartment-side evaporator occurs may be determined whether at least one information of information with respect to the inlet and outlet temperature difference of the refrigerating compartment-side evaporator and information with respect to the inlet and outlet temperature difference of the freezing compartment-side evaporator belongs to a preset range.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a compressor to compress a refrigerant;

a condenser to condense the refrigerant compressed in the compressor;

a refrigerant tube to guide flow of the refrigerant condensed in the condenser;

a plurality of capillary tubes to decompress the refrigerant condensed in the condenser, wherein the plurality of expansion devices are respectively provided along the plurality of refrigerant passages;

a plurality of evaporators to evaporate refrigerant respectively decompressed in the plurality of capillary tubes, the plurality of evaporators including a first evaporator for cooling a refrigerating compartment and a second evaporator for cooling a freezing compartment;

a plurality of refrigerant passages including first and third refrigerant passages coupled to an inlet of the first evaporator to guide introduction of the refrigerant into the first evaporator and a second refrigerant passage coupled to an inlet of the second evaporator to guide introduction of the refrigerant into the second evaporator;

a four-way valve provided at an inlet-side of the plurality of refrigerant passages, to separate the refrigerant into the first, the second and the third refrigerant passages;

a supercooling heat exchanger, at an outlet-side of the condenser and an inlet of the four-way valve, to supercool the refrigerant, wherein the compressor includes a first compressor at an outlet-side of the first evaporator and a second compressor at an outlet-side of the second evaporator, wherein both the refrigerant evaporated at the first evaporator and compressed refrigerant at the second compressor are suctioned into the first compressor and compressed therein, the plurality of capillary tubes includes a first capillary tube provided at the first refrigerant passage, a second capillary tube provided at the second refrigerant passage and a third capillary tube provided at the third refrigerant passage, wherein a diameter of the third capillary tube is less than a diameter of the first capillary tube, and the diameter of the third capillary tube is less than a diameter of the second capillary tube, and the supercooling heat exchanger includes a main tube connecting with the refrigerant tube and into which the condensed refrigerant is introduced, and a supercooling tube extended from the third refrigerant passage to allow refrigerant passing through the third capillary tube to be introduced into the supercooling tube and being heat exchanged with the main tube, and the main tube is coupled to an inlet of the four-way valve, and the supercooling tube is combined with a point of the first refrigerant passage.

2. The refrigerator according to claim 1, wherein the four-way valve to open at least two refrigerant passages of the first to third refrigerant passages based on an operation mode.

3. The refrigerator according to claim 1, further comprising:

a temperature sensor to detect inlet and outlet temperatures of the first evaporator or inlet and outlet temperatures of the second evaporator;

a memory for storing mapped information with respect to a control time of the four-way valve; and a control unit controlling the four-way valve to supply the refrigerant into the first and second evaporators based on the mapped information in the memory, wherein the control unit determines whether control time of the four-way valve changes, based on the information detected by the temperature sensor.

4. The refrigerator according to claim 3, wherein the information with respect to the control time of the four-way valve includes:

information with respect to a first set-up time at which an amount of refrigerant supplied to the first evaporator increases to prevent the refrigerant from being concentrated to the second evaporator; and information with respect to a second set-up time at which an amount of refrigerant supplied to the second evaporator increases to prevent the refrigerant from being concentrated to the first evaporator.

5. The refrigerator according to claim 4, wherein the control unit increases the second set-up time when it is determined that the refrigerant concentrates to the first evaporator and decreases the second set-up time when it is determined that the refrigerant concentrates to the second evaporator according to the information detected by the temperature sensor.

6. The refrigerator according to claim 4, wherein the flow adjustment part to open the first to third refrigerant passages for a first set-up time, and thereby increase the amount of refrigerant supplied to the first evaporator, and the flow adjustment part to open the second and third refrigerant passages for the second set-up time, and thereby increase the amount of refrigerant supplied to the second evaporator.

7. The refrigerator according to claim 1, wherein the combined point of the supercooling tube is positioned between the first capillary tube and an inlet of the first evaporator.

8. A method for controlling a refrigerator that includes a compressor, a condenser, a refrigerating compartment-side evaporator, and a freezing compartment-side evaporator, the method comprising:

operating the compressor to drive a refrigeration cycle and supercooling a refrigerant passing through the condenser by allowing the refrigerant to pass through a supercooling heat exchanger; and controlling a flow adjustment part, at an outlet-side of the condenser, based on an operation mode of the refrigerator, wherein the operation mode of the refrigerator includes a simultaneous operation mode of a refrigerating compartment and a freezing compartment, a refrigerating compartment operation mode, and a freezing compartment operation mode, and wherein the refrigerant passing through the flow adjustment part is separated into at least two refrigerant passages to flow based on whether the operation mode of the refrigerator is the simultaneous operation mode, the refrigerating compartment operation mode, or the freezing compartment operation mode.

9. The method according to claim 8, wherein a first refrigerant passage to guide the refrigerant to the refrigerating compartment-side evaporator, a second refrigerant passage to guide the refrigerant to the freezing compartment-side evaporator, and a third refrigerant passage to guide the refrigerant to the refrigerating compartment-side evaporator, and passing through the supercooling heat exchanger are connected to an outlet-side of the flow adjustment part.

10. The method according to claim 9, wherein, when the simultaneous operation mode is performed, the flow adjustment part to open the first to third refrigerant passages.

11. The method according to claim 9, wherein, when the refrigerating compartment operation mode is performed, the flow adjustment part to open the first and third refrigerant passages.

12. The method according to claim 9, wherein, when the freezing compartment operation mode is performed, the flow adjustment part to open the second and third refrigerant passages.

13. The method according to claim 9, further comprising:

changing an amount of refrigerant to the refrigerating compartment-side evaporator and the freezing compartment-side evaporator based on a set-up time; and determining a change in set-up time based on information with respect to an inlet and outlet temperature difference of the refrigerating compartment-side evaporator or an inlet and outlet temperature difference of the freezing compartment-side evaporator.

14. The method according to claim 13, wherein the changing of the amount of refrigerant based on the set-up time includes:

increasing the amount of refrigerant to the refrigerating compartment-side evaporator for a first set-up time to restrict refrigerant concentration to the freezing compartment-side evaporator; and increasing the amount of refrigerant to the freezing compartment-side evaporator for a second set-up time to restrict refrigerant concentration to the refrigerating compartment-side evaporator.

15. The method according to claim 14, wherein the determining of the change in set-up time includes determining whether the refrigerant concentration to the refrigerating compartment-side evaporator or the freezing compartment-side evaporator occurs, and whether the refrigerant concentration to the refrigerating compartment-side evaporator or the freezing compartment-side evaporator occurs is determined based on whether at least one information of information with respect to the inlet and outlet temperature difference of the refrigerating compartment-side evaporator and information with respect to the inlet and outlet temperature difference of the freezing compartment-side evaporator is within a preset range.

* * * * *